United States Patent [19]

Pogonowski

[11] 4,078,391

[45] Mar. 14, 1978

[54] METHODS FOR INTERCONNECTING TWO CYLINDERS

[75] Inventor: Ivo C. Pogonowski, Blacksburg, Va.

[73] Assignee: Texaco Inc., New York, N.Y.

[21] Appl. No.: 763,393

[22] Filed: Jan. 28, 1977

Related U.S. Application Data

[62] Division of Ser. No. 644,367, Dec. 24, 1975.

[51] Int. Cl.[2] ..... E02D 5/26

[52] U.S. Cl. ..... 61/53.68; 61/94; 29/523

[58] Field of Search ..... 61/53.68, 53.6, 53, 61/53.5, 94; 29/432, 523, 526; 227/9; 52/726, 288, 298

[56] References Cited

U.S. PATENT DOCUMENTS

| | | | |
|---|---|---|---|
| 3,375,670 | 4/1960 | Serota | 61/53.68 |

FOREIGN PATENT DOCUMENTS

| | | | |
|---|---|---|---|
| 599,786 | 7/1934 | Germany | 61/53.68 |
| 1,034,128 | 6/1966 | United Kingdom | 61/53.68 |

*Primary Examiner*—Jacob Shapiro
*Attorney, Agent, or Firm*—Carl G. Ries; Thomas H. Whaley; Theron H. Nichols

[57] ABSTRACT

Methods for joining two telescopic cylinders underwater and underground in a temporary and inexpensive manner are disclosed, particularly when used as anchoring piles or in offshore tower legs. A gun fires projectiles radially from internally of the pile formed of telescoped cylinders to form the plurality of outwardly extending anchoring bumps in the walls of the cylinders. The projectiles are fired in a horizontal plane immediately outwardly and from within and normal to two telescopic cylinders underwater, for example, with two bumps being formed by each projectile, which bumps overlie each other tightly prior to their being penetrated by the projectile which holds the two bumps together. A number of radiating guns form a like number of pairs of bumps in a circle around the periphery of the telescopic cylinders to form an efficient, inexpensive, and simple temporary connection holding the two cylinders together. After forming the bumps in the buried pile cylinders and simultaneously packing the soil around them, each projectile penetrates its bump and packed soil to provide a pile or offshore tower legs with high resistance to separation of the telescoped cylinders forming the pile or offshore tower legs, with increased load-carrying capacity, and with increased resistance-to-pull-out.

11 Claims, 6 Drawing Figures

METHODS FOR INTERCONNECTING TWO CYLINDERS

This is a division, of application Ser. No. 644,367, filed Dec. 24, 1975.

BACKGROUND OF THE INVENTION

An age-old problem has been to increase the load-carrying capacity of a pile and to increase its resistance against pullout in sandy or other granular soil, for example. Another problem has been the temporary joining of two tubes or cylinders, as when erecting an offshore tower with telescopic leg joints underwater to be held in place until permanently joined or fixed in position. Another problem is to temporarily join two cylinders without expensive and costly prior preparation.

The disclosed invention is an improvement over my prior methods and mechanisms for connecting two telescopic tubes together underwater illustrated in my U.S. Pat. No. 3,555,831, of Jan. 19, 1971, or 3,834,012 of Sept. 10, 1974. Other examples of increasing pile pullout resistance as by forming corrugations or bumps are disclosed in U.S. Pat. No. 3,453,831 (7-69), (4-68); and British Pat. No. 1,034,128 of 1964; and German Pat. No. 599,785, over which the disclosed invention is a substantial improvement.

OBJECTS OF THE INVENTION

Accordingly, a primary object of this invention is to provide a method for interconnecting two telescopic cylinders, particularly underwater.

A further object of this invention is to provide a method for forming a pile or offshore tower leg having, a highly load-carrying-capacity, and a highly resistance-to-pullout characteristic, and high resistance to separation of the telescoped cylinders forming a portion thereof.

A still further object of this invention is to provide a method for interconnecting two telescopic cylinders underwater in an efficient, quick, and economical manner.

A further object of this invention is to provide a method for interconnecting two telescoped cylinders that is easy to operate, is of simple operation, is economical to uses and is of greater efficiency for providing increased load-carrying-capacity and of increased resistance-against-pullout in a pile or an offshore leg in a sandy or other granular soil.

Other objects and various advantages of the disclosed method for interconnecting two telescopic cylinders will be apparent from the following detailed description, together with accompanying drawings, submitted for purposes of illustration only and not intended to define the scope of the invention, reference being had for that purpose to the subjoined claims.

BRIEF DESCRIPTION OF THE DRAWINGS

The drawings diagrammatically illustrate by way of example, not by way of limitation, a few forms or mechanisms for carrying out the method of the invention wherein like reference numerals have been employed to indicate similar parts in the several views in which.

DESCRIPTION OF THE INVENTION

The invention disclosed herein, the scope of which being defined in the appended claims, is not limited in its application to the details of construction and arrangement of parts shown and described for carrying out the disclosed methods, since the invention is capable of other embodiments for producing other methods and of being practiced or carried out in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

METHOD OF INTERCONNECTING TWO TELESCOPIC CYLINDERS UNDERWATER

Figure 5:
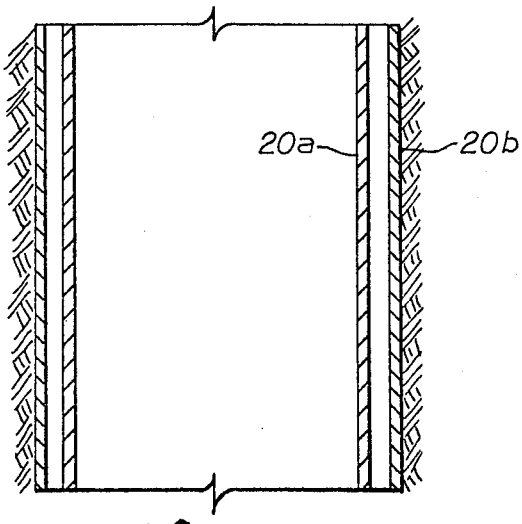
FIG. 5 is a schematic longitudinal sectional elevation of a portion of two telescopic cylinders prior to being fastened together in a second modified pile or offshore tower leg.
Figure 6:
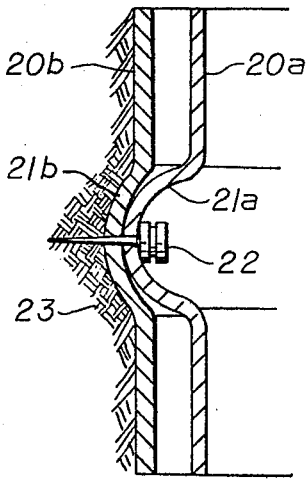
FIG. 6 is a longitudinal sectional elevation of a portion of two telescopic cylinders of FIG. 4 joined together.

A method for temporarily interconnecting two telescopic cylinders underwater buried in a sandy soil strata and other granular soils as illustrated in FIGS. 5 and 6, comprises the method steps of, (1) lowering a gun internally of the inner telescopic cylinder to the desired depth in the subsoil for firing head spikes radially outwardly in a horizontal plane, (2) forming a plurality of outwardly extending bumps in the horizontal plane around the periphery of the telescopic cylindrical walls extending into the subsoil with each bump of the inner wall lying in juxtaposition with the corresponding bump in the outer wall by driving a plurality of headed spikes radially outwardly into the cylinder walls, and (3) penetrating the bumps with the headed spikes after forming of the bumps by continued outward movement of the headed spikes for complete penetration of the bumps into the subsoil outside until only the spike heads remain in the inner cylinder and the two corresponding juxtapositioned bumps of each pair are squeezed together and held together underwater in the subsoil by the spikes.

A method of greater details comprises the following steps:

(1) inserting a plurality of spike guns into the inner telescopic cylinder to the desired depth radiating outwardly in a horizontal plane, (2) firing the spikes radially outwardly into the two telescopic cylinders for forming a plurality of outwardly extending pairs of bumps in the horizontal plane in a circle around the peripheral surface of the two telescopic cylinders, (3) forming the bump of each pair lying in close juxtaposition or contiguous with each other, (4) penetrating each pair of bumps with a headed spike after forming of the bumps, and (5) driving the headed spikes outwardly through both bumps until only the heads remain in the inner cylinder bump for squeezing each pair of contiguous bumps together in a joint underwater.

A HIGH LOAD CARRYING CAPACITY AND HIGHLY RESISTANT-TO-PULLOUT PILE

Figure 1:
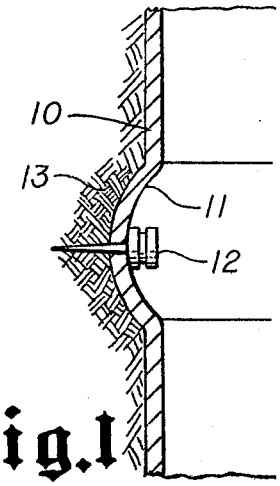
FIG. 1 is a schematic longitudinal sectional elevation of the portion of the pile in the ground having the new soil-holding feature of one modification of the invention.

FIG. 1 discloses a longitudinal sectional elevation of a portion of one modification of the pile 10 that is driven in the ground having the new soil-holding feature on it. This portion of the pile has a bump 11 formed in one side of it with a headed spike 12 driven into the middle of the bump and into the resultant packed soil 13 therearound. It may be noted that as the headed spike is driven into the pile wall from the inside, it first bulges out the side wall, making the hemispherical bump and packing the soil in that immediate area, then with added pressure and force the headed spike is driven through the center of the bump to protrude it completely outwardly into the dirt that has been packed around the bump. The packing of the dirt around the bump occurred with forming of the bump to compress the dirt that was around the vertical wall prior to the material of the bump being moved outwardly and compressing the dirt thereagainst.

Figure 2:
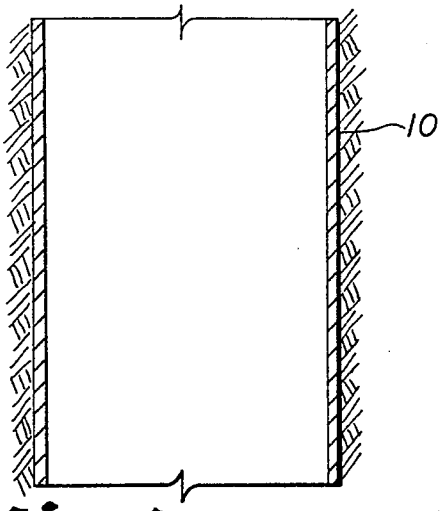
FIG. 2 is a schematic longitudinal sectional elevation of the pile of FIG. 1 prior to bulging and penetrating of the pile with headed spikes.

FIG. 2 is a schematic longitudinal sectional elevation of the pile 10 of FIG. 1 prior to bulging or penetrating of the pile with the headed spikes. Here a portion of the pile is shown driven into the dirt or ocean bottom after the dirt has been removed internally thereof, if necessary.

Figure 3:
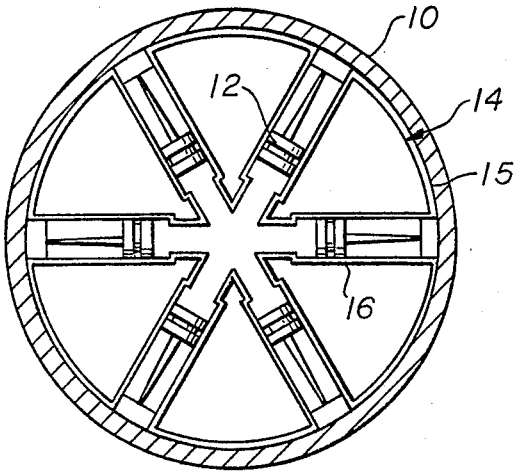
FIG. 3 is a schematic horizontal sectional view of the gun for forming the bumps in the pile walls and for driving the headed spikes into the pile wall for use in both modifications.

FIG. 3 is a schematic view or horizontal sectional view of the gun for driving the headed spikes 12 into the side walls of the pile 10. The gun 14 is positioned or lowered down into a pile to the depth of the sand strata where the bumps are desired to be formed. Here a cylindrical housing 15 that holds a multiplicity of barrels 16, all barrels being in a horizontal plane and firing radially outwardly. Gun housing 15 includes a high pressure fluid introduced behind the headed spikes 12 as controlled from the surface similar to the hydraulic guns disclosed in my above identified U.S. Pat. No. 3,555,831, but with the spike heads acting as the piston.

If more than one horizontal row of bumps is required, a multiple row gun may be used similar to that in my U.S. Pat. No. 3,834,012. With the gun housing positioned internally of the pile and ready for firing, the headed spikes may be fired in either of two ways. First, each barrel 16 or gun may be fired in consecutive order around the outer periphery of the gun to drive its respective headed spike 12 into the pile wall 10, or the second method may comprise the simultaneous firing of all guns at one time for driving all spikes simultaneously out through the pile into the packed ground therearound each bump, depending on the particular desired hydraulic ducting and controls from the surface to the guns.

Figure 4:
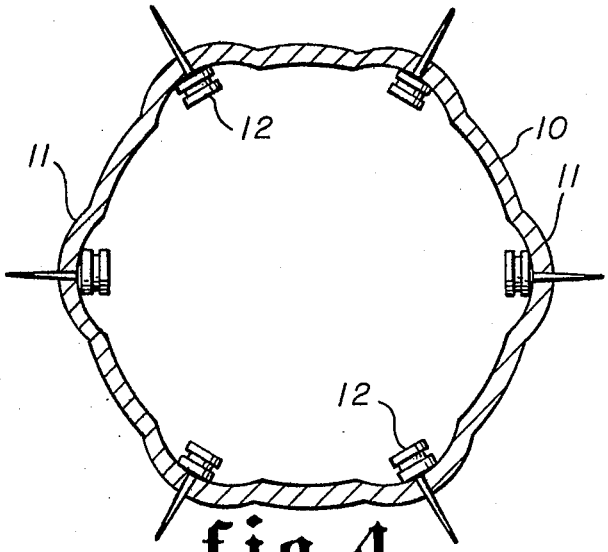
FIG. 4 is a schematic horizontal sectional view of the new pile after forming of the bulges and driving of the spikes through the walls of the cylinders by the gun of FIG. 3.

FIG. 4 is a horizontal sectional view after the gun 14 of FIG. 3 has been fired for forming the bulges and for packing the soil and for driving the spikes through the walls of the cylinder, the gun having been removed. Increased pull-out resistance results from both the bumps 11 and the headed spikes 17 protruding into the packed soil. Thus a pile having increased load-carrying-capacity and increased resistance-to-pull-out is disclosed.

A MECHANISM FOR CARRYING OUT THE ABOVE METHOD OF INTERCONNECTING TWO TELESCOPIC CYLINDERS UNDERWATER

FIG. 5 is a schematic longitudinal sectional elevation or view of the portion of the two telescopic cylinders 20*a*, 20*b*, prior to being fastened together for forming a modified pile or an offshore tower leg. This is a section buried underground in the area to be secured together.

FIG. 6 is a longitudinal sectional elevation of a portion of the two telescopic cylinders 20*a*, 20*b* joined together by a multiple barrel gun similar to gun 14. Here the two bumps 21*a* and 21*b* are shown after having been formed by the outward actuation or movement of a headed pin 22 which pin after having pushed or formed the bumps 21*a*, 21*b*, in the two surfaces of the two cylinders 20*a*, 20*b*, has now penetrated both walls into the packed soil 23, which soil was packed by the forming of the bump 21.

In operation of the embodiment of FIGS. 5 and 6, or for connecting the two telescoping cylinders together, at least temporarily, the guns, in this embodiment likewise, are made so that they may be fired in consecutive order around the periphery or they all may be fired simultaneously, if so desired. The guns are formed powerful enough to fire the headed spike out to engage the walls of the two bumps 21*a*, 21*b* of the two cylinders 20*a*, 20*b*. Upon first movement of the spike 22, the contiguous bulges 21*a*, 21*b* are formed thereby for packing the soil until finally with increased force or with continued force of outward movement, the spike penetrates both walls to extend therethrough. The spikes and bumps thus form a junction or connection connecting the two walls together for increasing the resistance to separation of the two interconnected telescoped cylinders for forming additional means for increasing the pull-out resistance of the outer cylinder from the soil therearound, and for increasing the load-carrying capacity of the interconnected cylinders when forming a portion of a pile.

Accordingly an efficient, inexpensive, and simple connection for holding two telescopic cylinders, as piles, or offshore tower legs, together.

Obviously other methods may be utilized for forming piles or offshore tower legs for burying in a sandy soil underwater and other methods may be used for interconnecting the two telescopic cylindrical tubes.

Accordingly, it will be seen that the disclosed new methods for forming pile mechanisms and telescopic tube mechanism, both including a particular gun, will operate in a manner which meets each of the objects set forth hereinbefore.

While only one mechanism has been disclosed, for performing the disclosed methods it will be evident that various other modifications are possible in the arrangement and construction of the disclosed method for interconnecting two telescopic cylinders for forming a pile or offshore tower leg without departing from the scope of the invention and it is accordingly desired to comprehend within the purview of this invention such modifications and methods as may be considered to fall within the scope of the appended claims.

I claim:

1. A method for interconnecting two cylinders having telescoped cylindrical walls buried in a sandy soil strata and other granular soils comprising the method steps of, (a) forming a plurality of outwardly extending bumps in a horizontal plane around the periphery of the telescoped cylindrical walls for packing the sandy soil strata around the bump by driving a plurality of headed spikes radially outwardly in the horizontal plane, and (b) penetrating each bump with a spike as the spikes are pressed outwardly further after forming the bump to lodge in the packed sandy soil strata with only the spike heads remaining in the telescopic cylinders for increasing the resistance to separation of the two interconnected telescopic cylinders, for increasing the load-carrying capacity of the interconnected cylinders when forming a portion of a pile, and for increasing the resistance to pullout of the interconnected telescopic cylinders in the sandy soil strata and other granular soils when used as a portion of a pile.

2. A method for interconnecting two cylinders having telescoped cylindrical walls buried in a sandy soil strata and other granular soils comprising the method steps of, (a) lowering a gun internally of the inner telescopic cylinder to the desired depth in the sandy soil strata for firing headed spikes radially outwardly in a horizontal plane, (b) pressing outwardly a plurality of outwardly extending bumps in a horizontal plane around the periphery of the telescoped cylindrical walls in the sandy soil strata by firing a plurality of headed spikes from within the inner cylinder radially outwardly in the horizontal plane to press the bumps outwardly in the telescoped cylindrical walls, (c) packing the soil around the bumps simultaneously with outward pressing of the bumps, (d) penetrating the bumps with the headed spikes after forming of the bumps by continued outward movement of the headed spikes until only the spike heads remain in the telescoped cylindrical walls, and (e) penetrating the soil with the spikes moving into the packed soil around the bumps for increasing the load-carrying capacity and for increasing the resistance to pullout and separation of the two interconnected cylinders in the sandy soil strata and other granular soils.

3. A method for interconnecting two cylinders having telescoped cylindrical walls buried in a sandy soil strata and other granular soils comprising the method steps of, (a) lowering a gun internally of the inner telescopic cylinder to the desired depth in the sandy soil strata for firing headed spikes radially outwardly in a horizontal plane, (b) driving a plurality of headed spikes from within the inner telescopic cylinder radially outwardly in a horizontal plane into the telescoped cylindrical walls, (c) forming a plurality of outwardly extending bumps in the horizontal plane in the outer periphery of the telescopic cylindrical walls by outward movement of the headed spikes, (d) simultaneously packing the soil around the horizontal row of bumps in the walls of the telescopic cylinders by forming of the bumps outwardly with the headed spikes, and (e) penetrating the bumps with the headed spikes for forming a horizontal row of anchoring extensions in the packed soil around each bump on the telescopic cylinders by continued driving of the plurality of headed spikes radially outwardly of the telescopic cylinders in a horizontal plane after forming of the bumps to penetrate the telescoped cylindrical walls and the packed soil until only the spike heads remain in the telescoped cylindrical walls for increasing the load-carrying capacity and the resistance to pullout and separation in the sandy and other granular soils.

4. A method for interconnecting two cylinders having telescopic cylindrical walls underwater in the subsoil comprising the method steps of, (a) lowering a gun internally of the inner telescopic cylinder to the desired depth of the subsoil for firing headed spikes radially outwardly in a horizontal plane, (b) forming a plurality of outwardly extending bumps in the horizontal plane around the periphery of the telescopic cylindrical walls extending into the subsoil with each bump of the inner wall lying in juxtaposition with the corresponding bump in the outer wall by driving a plurality of headed spikes radially outwardly into the cylinder walls, and (c) penetrating the bumps with the headed spikes after forming of the bumps by continued outward movement of the headed spikes for complete penetration of the bumps into the subsoil outside until only the spike heads remain in the inner cylinder and the two corresponding juxtapositioned bumps of each pair are squeezed together and held together temporarily underwater in the subsoil by the spikes.

5. A method for interconnecting two telescopic cylinders underwater comprising the method steps of, (a) inserting a plurality of spike guns into the inner telescopic cylinder to the desired depth radiating outwardly in a horizontal plane, (b) firing the spikes radially outwardly into the two telescopic cylinders for forming a plurality of outwardly extending areas of bumps in the horizontal plane in a circle around the peripheral surface of the two telescopic cylinders, (c) forming the bumps of each pair lying in close juxtaposition with each other, (d) penetrating each pair of bumps with a headed spike after forming of the bumps, and (e) driving the headed spikes outwardly through both bumps until only the heads remain in the inner cylinder bump for squeezing each pair of bumps together in a temporary joint underwater.

6. A method of interconnecting two telescopic cylinders having cylindrical walls for forming a high load capacity pile for being anchored in sandy soil strata and other granular soils comprising, (a) forming pairs of contiguous bumps in the telescopic cylindrical walls extending outwardly on the peripheral surface of the cylindrical walls of the pile in a horizontal plane after the pile is driven in the ground for providing compressed soil around the bumps, and (b) extending headed spike means radially outwardly from the center of each bump into the packed soil therearound each pair of bumps for providing a pile having increased resistance to separation of the telescoped cylinders, having increased load-carrying capacity, and having increased resistance-to-pullout in sandy and other granular soils.

7. A method for interconnecting two telescopic cylinders having cylindrical walls for forming a high load capacity pile comprising, (a) forming a plurality of pairs of contiguous bumps in the telescopic cylindrical walls of the pile, each pair of bumps being formed in a circular row in the peripheral surface of the telescopic cylindrical walls of the pile in a horizontal plane after the pile is driven into the ground for providing compact soil around each pair of bumps, and (b) protruding a plurality of headed spike means from the pile, each headed spike means extending radially outwardly from the center of each pair of contiguous bumps into the packed soil therearound each pair of bumps for providing a pile having increased resistance to separation of the telescoped cylinders, having increased load-carrying-capacity, and having an increased resistance-to-pullout in sandy and other granular soils.

8. A method for interconnecting two telescopic cylinders having cylindrical walls for forming an offshore tower supporting leg for being driven down into a sandy soil strata under the ocean bottom comprising, (a) extending pairs of bulges outwardly on the peripheral surface of the telescopic cylindrical walls of the portion at the layer of the sandy soil strata, (b) forming said pairs of bulges in a line on the peripheral surface of said telescopic cylindrical wall of the leg in a horizontal plane, (c) packing the soil around said pairs of bulges, and (d) extending said headed spike means radially outwardly through the center of each pair of said bulges into the packed soil around each pair of bulges for providing an offshore tower supporting leg having increased resistance to separation of the telescopic cylinder, having increased load-carrying-capacity, and having increased resistance-to-pullout in sandy and other granular soils.

9. A method for interconnecting two telescopic cylinders having cylindrical walls for forming an offshore tower supporting leg buried in a sandy soil strata below the ocean bottom comprising, (a) forming a plurality of pairs of contiguous bumps on the telescopic cylindrical contiguous walls of the leg, each pair of contiguous bumps being formed in a circular row extending outwardly in the peripheral surface of the telescopic cylindrical walls of the leg in a horizontal plane, (b) each pair of said bumps having compact soil closely packed up against it, and (c) protruding a plurality of headed spike means radially outwardly from the middle of each pair of contiguous bumps in the telescopic cylindrical walls of the leg into the packed soil therearound each pair of bumps for providing a pile having increased resistance to separation of the telescopic cylinders, having increased load-carrying-capacity, and having increased resistance-to-pull-out in sandy and other granular soils.

10. A method for interconnecting two telescopic cylinders buried underground comprising, (a) positioning a cylindrical shaped gun housing in the inner cylinder of the two telescopic cylinders, and (b) firing headed spikes into the cylindrical walls from the guns radiating outwardly in a horizontal plane after the guns have been lowered to the desired depth.

11. A method for interconnecting two telescopic cylinders wherein an inner cylinder is telescopically ,22 positioned in an outer cylinder underground comprising, (a) lowering a cylindrical shaped gun housing having a diameter slightly less than the inner cylinder internal diameter into the cylindrical walls to the desired depth, (b) pointing the guns outwardly in a horizontal plane in the cylindrical gun housing, (c) firing headed spikes from the guns into the telescoped cylindrical walls, (d) hitting the cylindrical walls with the spikes for forming a pair of overlying outwardly extending bumps, and (d) completely penetrating the walls of both overlying bumps with the spikes until only the spike heads remain in the inner cylinder underground.

* * * * *